United States Patent [19]

Nakajima et al.

[11] 4,066,090

[45] Jan. 3, 1978

[54] WATER COCK WITH NON-FREEZING VALVE

[75] Inventors: Kiminori Nakajima, Fujisawa; Ikuo Shigenobu, Machida, both of Japan

[73] Assignee: Echo Co., Ltd., Machida, Japan

[21] Appl. No.: 670,694

[22] Filed: Mar. 26, 1976

[51] Int. Cl.[2] ..... F16K 17/00

[52] U.S. Cl. ..... 137/62; 73/368.3; 137/599.2; 236/100; 237/80

[58] Field of Search ..... 137/59-62, 137/301, 468, 599.2; 236/99 I, 100; 73/368.3; 237/80

[56] References Cited

U.S. PATENT DOCUMENTS

| | | | |
|---|---|---|---|
| 1,153,863 | 9/1915 | Frank | 137/599.2 |
| 1,212,102 | 1/1917 | Pipe | 137/599.2 |
| 3,446,226 | 5/1969 | Canterbury | 137/62 |
| 3,591,075 | 7/1971 | Onishi | 236/100 X |

FOREIGN PATENT DOCUMENTS

| | | | |
|---|---|---|---|
| 596,751 | 1/1948 | United Kingdom | 137/599.2 |

*Primary Examiner*—Martin P. Schwadron
*Assistant Examiner*—Richard Gerard

[57] ABSTRACT

Water cock has non-freezing valve. Though temperature of the water flowing through the cock is lowered below the freezing point owing to the severe surrounding condition in the winter, the improved cock having a non-freezing valve does not stop its flowing of water. The cock has a thermo-element sensing the surrounding temperature and driving the non-freezing valve to shut and open according to the temperature. The thermo-element consists of a base portion containing heat-sensitive-material and a cylinder containing jelly-like material for transferring the expanding force of the heat-sensitive material to a shaft buried in the jelly-like material.

8 Claims, 3 Drawing Figures

WATER COCK WITH NON-FREEZING VALVE

Figure 1:
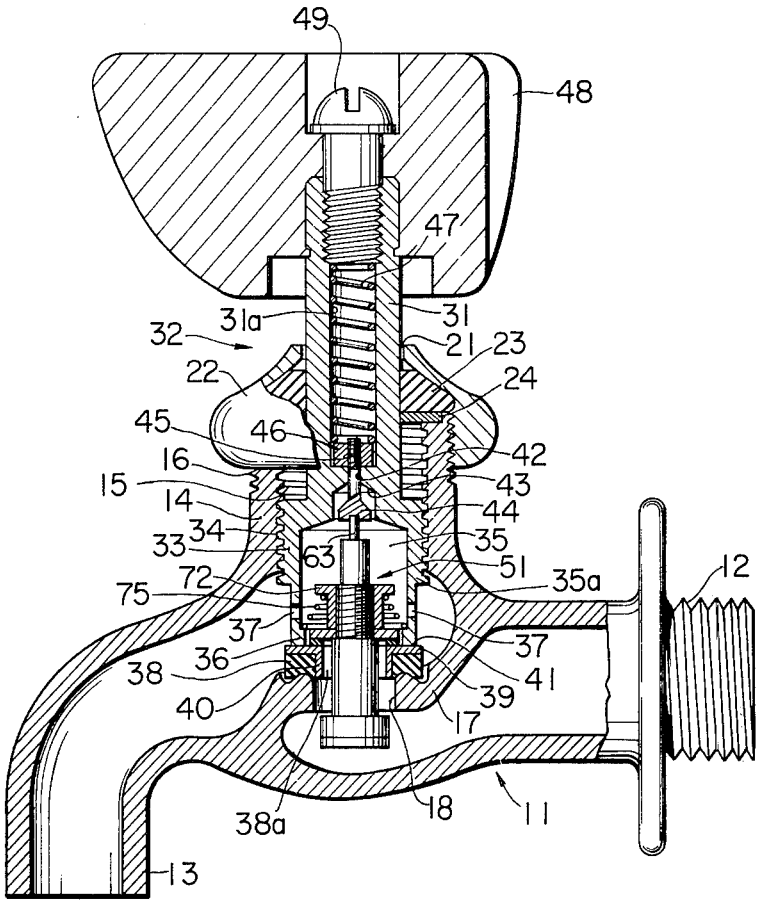

The present invention relates to a water cock and more particularly to a water cock with a non-freezing valve.

There have been many cases in which water in the water piping has frozen and the water has not flowed out through the water cock and furthermore the piping has broken off owing to the expanding ice.

According to the prior art for preventing the water piping from freezing or breaking off, the piping portion of the water piping which is exposed to the cold open air is covered with a heat insulation cover. The cover applying procedure is very troublesome and usually can not always prevent the piping from freezing or breaking off.

Generally the freezing has occurred in a piping portion exposed to the cold air and not on another portion buried into the earth in depth. That is to say that, in almost all countries or provinces, the temperature in the deep earth does not drop to below the freezing point.

Applicant of the present invention provides water cock with a non-freezing valve. According to the present invention, the water cock has a non-freezing valve installed therein. When the water contained in the cock is cooled to the freezing point due to the cold open air, the non-freezing valve functions to drain the cold water out of the cock and then the comparatively warm water in the piping portion buried in the earth flows to the cock and contacts with the non-freezing valve, causing reverse functioning of the valve and stopping the water flowing through the cock.

Actually, the comparatively warm water which has flowed within the buried water piping flows little by little through the non-freezing valve of the water cock.

It is rather easy to provide or make the water cock including a non-freezing valve as a special or exclusive appliance to be used or employed in the winter. However, the cost of the special water cock with the non-freezing valve is considerably high and furthermore it is troublesome to change the whole construction of the water cock at the beginning of the summer and winter from the standard cock to the special cock with the non-freezing valve. Consequently, the cock with the non-freezing valve is apt to be used through the four seasons consecutively and its useful life shortened.

One of the objects of the invention is to provide a non-freezing valve adapted to be installed in a conventional water cock.

Another object of the invention is to provide a non-freezing valve adapted to be easily installed or taken out from the conventional water cock that is relatively simple in construction and easy to mount within the cock.

Further, another object of the invention is to provide a non-freezing valve that is economically manufactured and yet effective when installed in the water cock as a safety valve in order to prevent the water pipe connected to the cock from freezing or bursting out.

Figure 2:
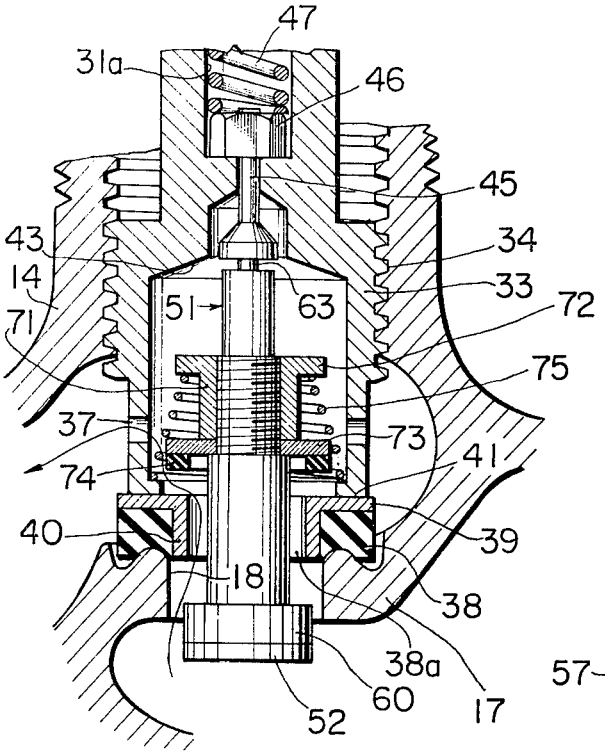
Figure 3:
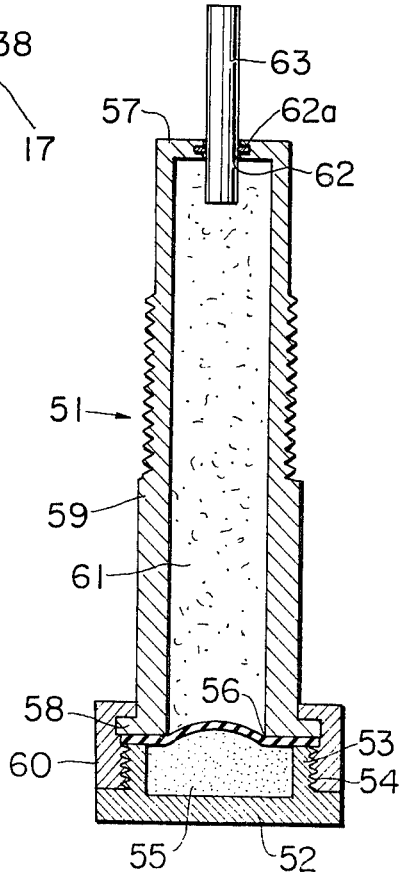

Other objects, features and advantages of the invention will become apparent upon reference to the following detailed description thereof, and to the drawings illustrating the preferred embodiment thereof, wherein:

FIG. 1 illustrates a cross-sectional view of the water cock and the non-freezing valve installed and positioned in the water cock so as to stop the water flowing through it, FIG. 2 shows a sectional view of especially the non-freezing valve so positioned as to flow the warm water through the water cock, and FIG. 3 is an enlarged sectional view illustrating a thermo-element sensing the temperature of water in the cock.

As shown in the drawing of FIG. 1, the non-freezing valve constructed according to the present invention consists of a cock body 11 having a base portion 12, a water outlet 13 and a threaded cylindrical portion 14 extruded from a center portion of the valve. A cock bar 32 is adapted to be inserted into the portion 14 from the top and engages a threaded inner surface 15 of the cylindrical portion 14. A cap 22 is applied onto the top of portion 14 and engages the threaded outer surface 16 thereof in order to prevent the water from leaking out through the cylindrical portion 14. The cap 22 has a top opening 21 through which a tubular member 31 is inserted and contains two packings 23, 24 of ring shape, which contact the tubular outer wall of the member 31 in order to prevent the water from leaking. A partition wall 17 having a primary valve opening 18 is formed within the cock body 11.

It is possible to employ the conventional construction of the water cock body 11 having the cap 22 in the embodiment of the invention.

The important feature of this invention resides in the lower portion of the tubular member 31 and the thermo-element 51 adapted to be assembled to the tubular member 31.

The tubular member 31, the cap 22 and the set of packings 23, 24 compose a tubular member assembly 32. In order to attach the assembly 32 to the cock body 11, at first the packings 23, 24 are pressed into the cap 22, then the tubular member 31 is inserted into the cap from its bottom opening. Next, the lower threaded portion 34 of the tubular member 31 is engaged with a female thread portion 15 formed on an inner surface of the cylindrical portion 14. The big end 33 has a cavity portion 35 opened at it lower end. The cavity portion 35 is formed by a cylindrical wall **35*a* integrally formed on the big end. The wall 35*a* has a flange 36 formed on the inner surface of a depending thin wall so as to extrude inwardly. Two through-holes 37 are formed in the thin wall, through which water flows. Under a bottom surface of the flange 36, an attachment member 39 is attached, and a main packing 38 is held in position by the attachment member 39. The member 39 consists of a flange portion 41 and a cyclindrical portion 40. As shown in FIG. 1, the flange and cylindrical portions 40, 41 contact with the upper surface and side surface of the main packing 38. A central opening 38*a* of the cylindrical portion 40 is functionally a secondary valve opening. A supplemental packing is adapted to contact with an upper surface of the flange portion 41 in order to close the central opening 38*a*** and open it, permitting cold water to flow out from the cock body.

As shown in FIG. 1, the tubular member 31 has a cylindrical cavity **31*a* and a partition wall 43 formed between the cylindrical cavity and the cavity portion 35. The partition wall 43 has a through-hole 42 through which a stopper 45 is inserted. The stopper 45 has a lower receiving end 44 and an upper threaded end. A nut 46 engages the upper threaded end in order to controllably position the stopper. Then, a lower surface of the nut 46 contacts an upper surface of the partition wall 43**.

The outer diameter of an upper thin portion of the stopper 45 is made smaller than the inner diameter of the through-hole 42, permitting raising of the stopper 45 until the receiving end 44 contacts with the partition wall 43. On the nut 46, a compression coil spring 47 is mounted and positioned within the cylindrical cavity 31*a*. The coil spring 47 is compressed when a handle 48 is fitted on an upper end of the tubular member 31 and a bolt 49 is engaged to a female thread on the top portion of the tubular member 31.

The thermo-element 51 is adapted to be operatively mounted within the cavity portion 35 of the tubular member 31.

The construction of the thermo-element 51 will be explained with reference to FIG. 3.

The bowl type base portion 52 of the thermo-element 51 has a thread 54 formed on the side of erected wall 53. Wax material 55 is filled in the base portion 52 level with the top of the erected wall 53. The wax is selected from the group of materials which undergo a considerable change in volume with a change of temperature. On the upper surface of the wax material, a film 56 such as of rubber material is placed. On the film 56, a flanged cylinder 59 having an open bottom is mounted through a bottom surface of a flange 58. Consequently, the peripheral portion of the film 56 is held or pressed between the bottom surface of the flange and the top of the erected wall of the base portion 52. The base portion and the flanged cylinder 59 are connected to each other by a connecting ring 60 adapted to be engaged with the thread 54 of the erected wall 53. The flange 58 of the cylinder 59 is pressed by a top flange of the connecting ring 60 and the erected wall 53 is pulled upward by the thread portion 60 of the connecting ring 60, so that the cylinder 59 and the base portion 52 are integrally combined and firmly held at their relative positions.

The interior of the cylinder 59 is filled with a jelly-like material 61 such as silicone oil and a shaft 63 is inserted in the cylinder through an opening 62 of a top wall 57, so as to place a lower portion of the shaft 63 in the jelly-like material. The material is selected from the group of non-heat-expandable materials. An O-ring 62*a* placed in the inner wall of the opening 62 and contacting the shaft 63 seals up the cylinder 59, so that the material does not leak out from the cylinder.

In operation, when the volume of the wax material 55 is increased owing to raising of its temperature, the film 56 on the material is bulged upwardly and pressed into the cylinder 59. Consequently, the jelly-like material contained in the space of the cylinder presses against the shaft portion placed within the material and pushes up the shaft so as to vertically raise the shaft 63. On the other hand, when the volume of the wax material is decreased owing to low temperature of water surrounding the base portion 52, the film is depressed or hollowed downwardly and the silicone oil is drawn downward through the cylinder 59. Subsequently, the shaft 63 is drawn back into the space of the cylinder 59.

To an intermediate portion of the cylinder 59, a flanged pipe 71 having a female thread portion engages through a male thread portion formed on the intermediate portion. The flanged pipe 71 has an upper flange 72 and a lower flange 73, on an under surface of the lower flange a supplemental ring packing 74 is attached. A tapered coil spring 75 is applied to the flanged pipe 71, with its top end contacting an under surface of the upper flange 72 and its lower end contacting the upper surface of the flange 36 of the depending thin wall. The top end of the shaft 63 is attached to an under surface of the receiving end 44 of the stopper. When the water surrounding the base portion 52 containing wax material is higher in its temperature than the freezing point, the supplemental packing 74 is tightly pressed on the upper surface of the flange of the attachment member 39, so that the secondary central opening 38*a* of the main packing 38 is shut by means of the lower flange 73 of the pipe 71, the cylinder 59 of the thermo-element 51, and the supplemental packing 74.

The operation of the water cock with a non-freezing valve, under the surrounding condition of normal temperature, will be described with reference to FIGS. 1 and 2.

Under the normal condition, the primary opening 18 and secondary opening 38*a* are kept at their closed positions as shown in FIG. 1. In order for water to flow from the cock body 11 under the normal condition, the handle 48 is rotated so as to raise the tubular member 31. Consequently, the main packing 38 is raised by the depending thin wall and the flanged attachment member 39 and separated from a valve seat of the primary opening 18, allowing the water to flow through the ring-like space between the main packing 38 and the valve seat to the water outlet 13. Of course, this time, the secondary opening 38*a* is kept in its closed condition.

The operation of the water cock with a non-freezing valve, in temperatures below the freezing point of water, will be described with reference to FIG. 2. When the wax material 55 contained in the thermo-element 51 is decreased in its volume, the shaft 63 is withdrawn into the jelly like material 61 of the thermo-element 51. Therefore, the distance that the shaft 63 extends beyond the lower flange 73 is shortened. The coil spring 75 functions to raise the flange pipe 71 and the thermo-element 51, allowing the separation of the supplement packing 74 from the upper surface of the flanged attachment member.

Consequently, the secondary opening 38*a* is opened and the water enters the cavity portion of the big end 33 through the primary valve opening 18, the secondary valve opening 38*a*, and finally the ring-shaped opening between the supplemental packing 74 and the flanged attachment member 39. The water flows out from the outlet 13 of the cock through the through-holes 37. When the cold water surrounding the base portion 52 is drained out from the outlet 13 and the relatively warm water flows into the space around the base portion, the shaft 63 is forced out from the tubular member 31 and the thermo-element is pushed down, resulting in contacting the supplemental packing 74 with the flanged attachment member and closing the secondary opening 38*a*.

The function of the compressed coil spring 47 will be explained with reference to FIG. 1. When the surrounding temperature of the water cock is very high in the summer, the shaft 63 will be pushed up for a predetermined distance and the stopper 45 will be pressed up. Then, the nut 46 engaged with the stopper 45 pushes up the coil spring 47 and the pressure force of the stopper 45 is absorbed by the spring 47. In consequence, no damage will occur in the water cock having the non-freezing valve manufactured in accordance with the invention.

Although certain structures of the invention have been shown and described in detail in conjunction with the preferred embodiment shown, it will be understood that changes may be made in the design and arrangement of parts without departing from the spirit of the present invention.

I claim:

1. In a water cock having a cock body provided with a cylindrical portion, a water outlet and a water inlet, a tubular member provided with a handle and engaged with a threaded portion formed in said cylindrical portion, a partition wall separating the inner space of the cock body into two compartments, one in communication with the inlet and the other in communication with the outlet, a primary valve opening formed in the partition wall so as to be placed under the lower end of the tubular member in order to allow communication between the chambers, a cap through which said tubular member is passed and which seals the cylindrical portion by a packing system contained within the cap contacting firmly with the tubular member; the improvement comprising a cavity portion formed at the lower end of the tubular member, a ring-shaped main packing positioned on a circular lower edge of the cavity portion so as to be concentric with the circular lower edge in order to close said primary valve opening as a result of a turning of said handle, said cavity portion having at least one through-hole formed in its depending wall for the flow of cold water therethrough to the outlet, a thermo-element containing heat-sensitive material the volume of which changes in response to change in water temperature, a shaft partially contained in said thermo-element and adapted to be slid in and out of said thermo-element in response to said volume change, and a valve mechanism for opening and closing a central opening of said main packing in response to the action of said thermo-element, whereby water is permitted to flow through said central opening and subsequently through said through-hole to said outlet in response to a temperature change of said heat-sensitive material, said thermo-element and said valve mechanism being at least partially contained within the cavity portion.

2. The improvement according to claim 1, wherein said thermo-element has a base portion containing said heat-sensitive material and a cylinder containing jelly-like material, and the heat-sensitive material and jelly-like material are separated from each other by a film placed between them, said shaft being partially inserted in said cylinder.

3. The improvement as claimed in claim 2, wherein said heat-sensitive material comprises a wax material and said jelly-like material comprises silicone oil.

4. The improvement according to claim 2, wherein at least said base portion containing the heat-sensitive-material is placed in the water compartment connecting to the water inlet.

5. The improvement according to claim 2, wherein said valve mechanism comprises a flanged pipe on said thermo-element having a lower flange outwardly extruded, on the under surface of which a supplemental packing is attached, said supplemental packing being positioned to cooperate with the main packing and being pressed against the main packing through an attachment member attaching the main packing to the tubular member.

6. The improvement according to claim 5, wherein said flanged pipe also has an upper flange outwardly extruded, a compressed coil spring is placed between the upper flange and an inwardly extruded flange formed at the lower end portion of the circular depending wall of the cavity portion, and said coil spring functions to bias the thermo-element away from said main packing.

7. The improvement according to claim 6, wherein said compressed coil spring is placed around the thermo-element in order to raise the element, so that the top end of the shaft is pressed against a portion of the tubular member, whereby in operation the supplemental packing mounted on the under surface of the outwardly extruded flange is pressed against the upper surface of said attachment member when water temperature is higher than the freezing point, and separated therefrom in order to open the central opening of the main packing when the temperature is at or below the freezing point.

8. The improvement according to claim 1, wherein said tubular member has a cylindrical inner space separated from the cavity portion through a partition wall provided with a second through-hole, a stopper having a receiving end at its lower end and a nut at its top end is adapted to be loosely inserted through the second through-hole, and a compressed coil spring is contained in the cylindrical inner space so as to be compressed between the nut and a handle fastening bolt, whereby in operation said shaft is pressed against the receiving end of the stopper.

* * * * *